US010988307B2

(12) United States Patent
Stefanoni

(10) Patent No.: US 10,988,307 B2
(45) Date of Patent: Apr. 27, 2021

(54) DISPOSABLE CAPSULE FOR DISPENSING MACHINES OF INFUSED BEVERAGES

(71) Applicant: IMPER S.P.A., Turin (IT)

(72) Inventor: Roberto Stefanoni, Oggiono (IT)

(73) Assignee: IMPER S.P.A., Turin (IT)

( * ) Notice: Subject to any disclaimer, the term of this patent is extended or adjusted under 35 U.S.C. 154(b) by 153 days.

(21) Appl. No.: 16/332,825

(22) PCT Filed: Sep. 15, 2017

(86) PCT No.: PCT/IB2017/055598
§ 371 (c)(1),
(2) Date: Mar. 13, 2019

(87) PCT Pub. No.: WO2018/055497
PCT Pub. Date: Mar. 29, 2018

(65) Prior Publication Data

US 2019/0248577 A1 Aug. 15, 2019

(30) Foreign Application Priority Data

Sep. 21, 2016 (IT) ..... 102016000094824

(51) Int. Cl.
*B65D 85/80* (2006.01)
*B65D 85/804* (2006.01)

(52) U.S. Cl.
CPC ..... *B65D 85/8043* (2013.01)

(58) Field of Classification Search
CPC ..... B65D 85/8043; B65D 85/804; B65D 85/8046
See application file for complete search history.

(56) References Cited

U.S. PATENT DOCUMENTS

2003/0096038 A1* 5/2003 Cai ..... A47J 31/14 426/77
2004/0115317 A1 6/2004 Doglioni
(Continued)

FOREIGN PATENT DOCUMENTS

EP 1426160 A1 6/2004
EP 1472156 B1 3/2006
(Continued)

OTHER PUBLICATIONS

International Search Report and Written Opinion for International Application No. PCT/IB2016/052638 (dated Sep. 6, 2016) (12 Pages).
(Continued)

*Primary Examiner* — Ericson M Lachica
(74) *Attorney, Agent, or Firm* — Lucas & Mercanti, LLP

(57) ABSTRACT

A disposable capsule for use in beverage machines is disclosed. The capsule has a hollow, cup-shaped body adapted to receive a measured dose of a syrup, a liquid or a powder concentrate. The hollow body has an insert housed therein which includes a disc-shaped portion and a stem which stretches out axially from the top of the disc-shaped portion. The stem has an axial through cavity which defines a channel for the dispensing of a beverage. The through cavity includes an inlet formed at an end of the stem located close to the cover of the capsule and an outlet formed at the opposite end of the stem.

10 Claims, 5 Drawing Sheets

(56) References Cited

U.S. PATENT DOCUMENTS

| | | | | |
|---|---|---|---|---|
| 2005/0150390 | A1* | 7/2005 | Schifferle | B65D 85/8043 99/295 |
| 2007/0196402 | A1 | 8/2007 | De La Mettrie | |
| 2013/0105340 | A1 | 5/2013 | Hother et al. | |
| 2014/0053735 | A1 | 2/2014 | Verbeek | |
| 2014/0161940 | A1 | 6/2014 | Aviles | |
| 2018/0134485 | A1 | 5/2018 | Stefanoni | |

FOREIGN PATENT DOCUMENTS

| | | | |
|---|---|---|---|
| EP | 1344722 | B2 | 10/2011 |
| WO | 03059778 | A2 | 7/2003 |
| WO | 2004065257 | A1 | 8/2004 |
| WO | 2004084687 | A1 | 10/2004 |
| WO | 2008132571 | A1 | 11/2008 |
| WO | 2010137960 | A1 | 12/2010 |
| WO | 2012004256 | A1 | 1/2012 |
| WO | 2012121597 | A1 | 9/2012 |
| WO | 2013026651 | A1 | 2/2013 |
| WO | 2013124234 | A1 | 8/2013 |
| WO | 2014057094 | A1 | 4/2014 |
| WO | 2014102701 | A1 | 7/2014 |
| WO | 2014195307 | A1 | 12/2014 |
| WO | 2015032787 | A1 | 3/2015 |
| WO | 2015059020 | A2 | 4/2015 |
| WO | 2015059022 | A1 | 4/2015 |
| WO | 2015124526 | A1 | 8/2015 |
| WO | 2015124558 | A1 | 8/2015 |
| WO | 2015136433 | A1 | 9/2015 |

OTHER PUBLICATIONS

International Search Report and Written Opinion for International Application No. PCT/IB2016/057865 (dated Apr. 3, 2017) (12 Pages).

International Search Report and Written Opinion for International Application No. PCT/IT2015/000313 (dated Sep. 7, 2016) (10 Pages).

International Preliminary Report on Patentability for International Application No. PCT/IT2015/000313 (dated Dec. 7, 2017) (13 Pages).

International Search Report and Written Opinion for International Application No. PCT/EP2016/071682 (13 Pages) (dated Oct. 21, 2016).

International Search Report and Written Opinion for International Application No. PCT/IB2017/051410 (13 Pages) (dated May 19, 2017).

International Search Report and Written Opinion for International Application No. PCT/IB2017/055598 (dated Nov. 6, 2017) (14 Pages).

* cited by examiner

DISPOSABLE CAPSULE FOR DISPENSING MACHINES OF INFUSED BEVERAGES

CROSS-REFERENCE TO RELATED APPLICATIONS

This application is a 371 of PCT/IB2017/055598, filed Sep. 15, 2017, which claims the benefit of Italian Patent Application No. 102016000094824, filed Sep. 21, 2016.

TECHNICAL FIELD OF THE INVENTION

The present invention generally relates to the preparation of beverages based on syrups, liquid or powder concentrates from disposable capsules. More particularly, the invention relates to a disposable single-dose or multi-dose capsule for dispensing machines of infused beverages.

BACKGROUND

Known disposable capsules for the preparation of beverages based on syrups, liquid or powder concentrates are used in dispensing machines for infused beverages. These capsules typically comprise a sealed cavity inside which a syrup, a liquid or powder concentrate is contained. A beverage is obtained by placing the capsule into an infusion chamber of a beverage dispensing machine and by subsequently piercing the capsule with one or more special perforators at a cover and a bottom thereof so as to allow passage of a flow of liquid therethrough. Depending on the types of dispensing machine and capsule, the liquid can flow from the cover of the capsule to its bottom or in the opposite direction.

The Italian patent application 102015000051841 in the Applicant's name describes for example a disposable capsule of the type above comprising a cup-shaped hollow body whose top is sealed by a cover secured to a flange thereof and whose bottom is sealed by a film applied inside the body cavity. A dispensing opening is formed at the bottom of the capsule body. The dispensing opening is funnel-shaped and serves as a dispensing duct for an infused beverage, thus allowing to simplify the structure of the infusion group of a dispensing machine and to avoid contamination of flavors between beverages produced consecutively, which is caused by a progressive soiling of the dispensing duct of a traditional infusion group.

The hollow body houses an insert comprising a frustoconical disc portion and a stem axially extending from the top of said frustoconical disc portion. The frustoconical disc portion rests on the bottom of the capsule, while the stem extends axially beyond the top of the capsule, so that the cover features a dome shape once applied to the cup-shaped hollow body of the capsule.

A plurality of through openings are formed in the mantle of the frustoconical disc portion, while perforation elements are formed in its concave portion. The perforation elements face the film which seals the bottom of the capsule.

The insert is axially movable between an assembling or packaging position, wherein the frustoconical disc portion rests on the bottom of the hollow body and the free end of the stem presses against the cover deforming it outwards, and an opening position, wherein the free end of the stem is advanced in an axial direction and the frustoconical disc portion is flattened on the bottom, whereby the perforating elements interfere with the inner film and cut it.

Hence, opening of the capsule for dispensing the infused beverage occurs mechanically inside it due to the movement of the insert upon closing of the infusion chamber of a beverage dispensing machine. When closing the infusion chamber in fact a special lever of the machine presses against the capsule cover, thereby moving axially the stem of the insert arranged under the cover.

The insert of the capsule described in the Italian patent application 102015000051841 also includes a cup-shaped element serving as a distributor for the infusion liquid. The cup-shaped element is housed in the capsule body in a seat formed close to a flanged edge thereof. The stem is tightly fitted in an aperture formed in the middle of the cup-shaped element and having a corresponding diameter. The overall configuration of the capsule in a packaging configuration is such that the insert separates the capsule cavity in two adjacent, non-communicating sectors. When the capsule is placed in the infusion group of a dispensing machine as indicated above, the insert stem is made to advance axially, thus creating a radial clearance with the aperture formed in the cup-shaped element and allowing passage of the infusion fluid into the cavity so as to form the beverage. The beverage is dispensed from the bottom of the capsule through the inner film, which has been cut by the perforating elements formed in the frustoconical disc portion of the insert.

Another example of a disposable capsule of the above type is described in the international publication WO 2012/121597 A1.

This capsule comprises a cup-shaped, hollow body suitable to receive a measured dose of a granular or particle product. The cup-shaped body comprises a side wall and a frustoconical bottom wherein a plurality of through openings are formed. The top of the cup-shaped body is sealed by a cover secured to a peripheral flange, while the bottom wall is sealed by a film applied from below, i.e. arranged outside the cup-shaped body.

On the surface of the bottom wall facing the film that seals the cup-shaped body, one or more perforating elements are formed. On the opposite surface of the bottom wall a rod-like element extending axially towards the cover is formed. The rod-like element is hollow and features a plurality of indentations formed at its free facing the cover. The cavity of the rod-like element is blind at the bottom wall of the cup-shaped body.

The capsule described in the international publication WO 2012/121597 A1 is configured to be inserted into an infusion chamber of a machine for infused beverages. An injector needle of the machine punctures the cover at the cavity of the rod-like element, whereby an infusion liquid fills the cavity and flows out into the cavity of the cap-shaped body of the capsule through the indentations formed at the free end of the rod-like element. The injector needle is associated with a shaped element which, simultaneously with the cover perforation step, presses against the rod-like element and causes it to move relative to the lateral wall of the cup-shaped body, thereby deforming its bottom wall toward the film sealing it from below. The perforating elements formed on the bottom wall cut the film thus allowing the infused beverage to be dispensed.

A further example of disposable capsule of the aforesaid type is described in the international publication WO 2014/102701 A1. In this case the capsule comprises an axially deformable body and a hollow insert extending axially from the top to the bottom thereof, from which it opens out of the capsule. The end of the hollow insert arranged inside the capsule body is sealed against the cover of the capsule, while the opposite end, which protrudes beyond the bottom of the capsule and is therefore outside it, is sealed by a film applied on the bottom from the outside.

The cavity of the insert is divided in two separate parts that are respectively set in fluid communication with the body cavity of the capsule through at least one injection port and one outlet. An infusion fluid supplied by the infusion group of an infused beverage dispensing machine is injected into the insert and dispensed into the cavity of the capsule body through the injection port, where it is mixed with a food product so as to form an infused beverage. By axially deforming the body of the capsule, the infused beverage thus obtained is forced to flow out of the capsule through the outlet of the insert.

Capsules of this type are extremely effective in causing a capsule to be opened from the inside so as to allow dispensing of an infused beverage, but have the drawback that they cannot prevent leakage of residues of a beverage at the end of the dispensing step. At the end of this step in fact a certain amount of the liquid injected into the capsule inevitably remains inside it.

Moreover, prior art capsules of this type can be improved as far as mixing between the infusion liquid and the product contained therein is concerned, which is particularly important for products such as syrups, liquid and powder concentrates, where the organoleptic properties of the beverage produced heavily depend on mixing among the ingredients.

SUMMARY OF THE INVENTION

The technical problem underlying and solved by the present invention is therefore to provide a disposable capsule for dispensing machines of beverages based on syrups, liquid and powder concentrates, that allows to overcome the drawbacks mentioned above with reference to the prior art.

This problem is solved by a disposable capsule according to claim 1. Preferred features of the present invention are specified in the dependent claims.

An idea of solution underlying the invention is to provide a disposable capsule that is similar to the capsule described in the co-pending Italian patent application 102015000051841 in the Applicant's name as far as the shape of the capsule body and the operation principle of the capsule insert are concerned. Unlike the disposable capsule of the above-mentioned Italian patent application, the insert of the capsule according to the invention comprises only a disc like portion and a stem, but not a cup-shaped element serving as a distributor.

Another difference between the insert of the disposable capsule described in said Italian patent application and the disposable capsule according to the invention is that the mantle of the disc shaped portion does not have through openings and the stem comprises an axial through cavity that defines a dispensing channel for an infused beverage.

The overall configuration of the insert is such that, when an infusion liquid is injected into the capsule cavity by piercing the cover with a conventional perforator, the infusion fluid is directed towards the bottom of the capsule cavity, is mixed with the product contained therein, be it a syrup, a liquid or powder concentrate, and flows back to the cover until it enters the channel defined by the stem and thus flows out of the capsule.

Thanks to these features, dispensing of the infused beverage from the capsule occurs as it happens in a siphon, which eliminates the leakage problems typically occurring at the end of a dispensing step due to the residues of infusion liquid remaining inside the capsule.

In other words, leakage is prevented because the inlet for dispensing the beverage is spaced from the bottom of the capsule, where residues of the infused beverage remain by gravity at the end of the dispensing step. Unlike the capsule of the invention, the capsule disclosed in the international publication WO 2014/102701 A1 cannot avoid leakage of beverage residues because, the axially hollow stem notwithstanding, a deformation of the capsule body is required in the axial direction in order to allow dispensing of a beverage, which brings the bottom up to the inlet opening for the dispensing of the beverage.

An advantage provided by the invention is that circulation of the infusion liquid from the bottom to the top of the capsule and the subsequent outflow of the infused beverage through the insert stem promote mixing of the beverage for the benefit of its organoleptic qualities.

According to an embodiment of the invention, the insert comprises a frustoconical disc portion and a shaft extending axially from the top of the frustoconical disc portion. The frustoconical portion disc portion rests on the bottom of the capsule while the stem extends axially beyond the top of the capsule, so that the cover assumes a domed shape when it is applied to the cup-shaped hollow body of the capsule. The frustoconical disc portion comprises a plurality of perforation elements facing the inner film that seals the bottom of the capsule.

The perforation elements are preferably radially spaced from the dispensing opening formed at the bottom of the capsule. Hence, an infused beverage dispensed through the channel of the insert stem does not flow out axially, but is radially deviated by the film that seals the bottom until it reaches the openings formed by the perforation elements. This configuration reduces swirling of the infused beverage and bubble formation, which is preferred in the case of beverages obtained from powder concentrates.

According to an alternative embodiment of the invention, the insert is arranged substantially upside down, i.e. its disc shaped portion is restrained close to the top of the capsule through an annular breakable element, while the stem extends axially from the disc shaped portion to the bottom of the capsule. Upon closure of the capsule in an infusion chamber, the disc shape portion is detached from the annular element and the insert stem pierces the film sealing the capsule bottom while moving close to the dispensing opening. The dispensing opening has a cross section smaller than the cross section of the channel formed in the hollow stem, thereby accelerating the stream of beverage flowing out of the capsule. This feature is highly advantageous in the case of beverages based on syrups and liquid concentrates, because it contributes to their mixing.

Further advantages, features and applications of the present invention will become clear from the following detailed description of embodiments thereof, which are disclosed as non-limiting examples.

BRIEF DESCRIPTION OF THE FIGURES

Reference will be made to the figures of the accompanying drawings, in which.

DETAILED DESCRIPTION OF PREFERRED EMBODIMENTS

Figure 1:
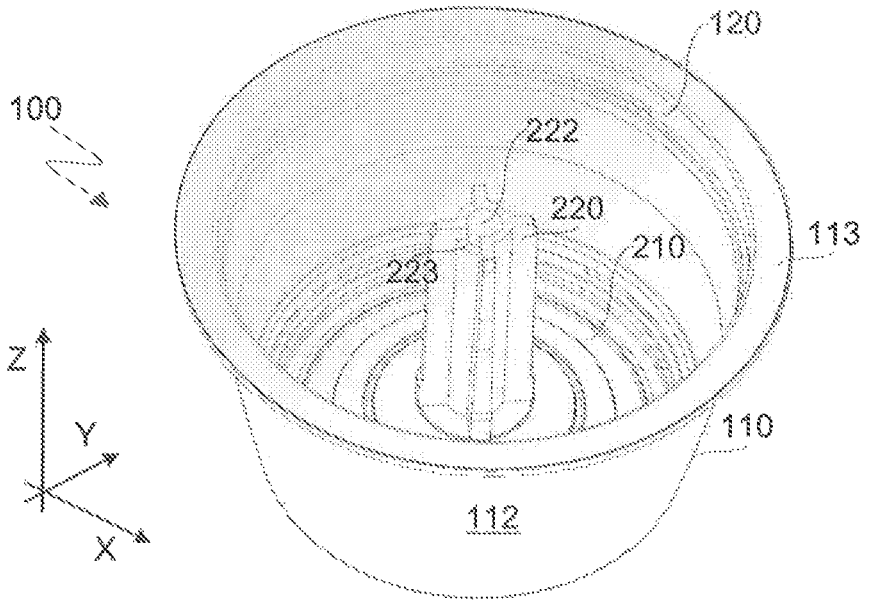
FIGS. 1 and 2 are perspective top and bottom views, respectively, of a capsule according to an embodiment of the invention.
Figure 2:
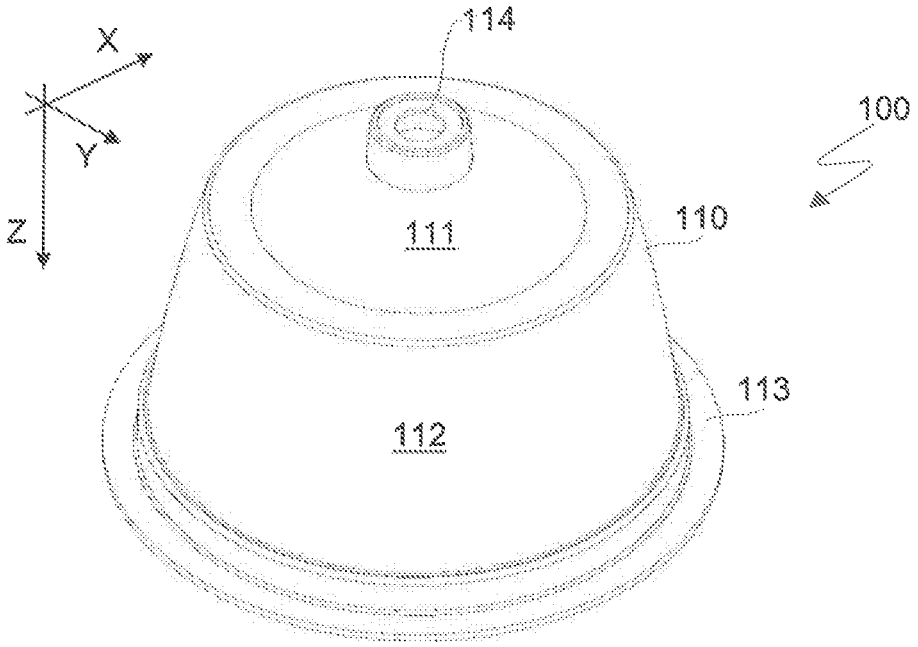
Figure 3:
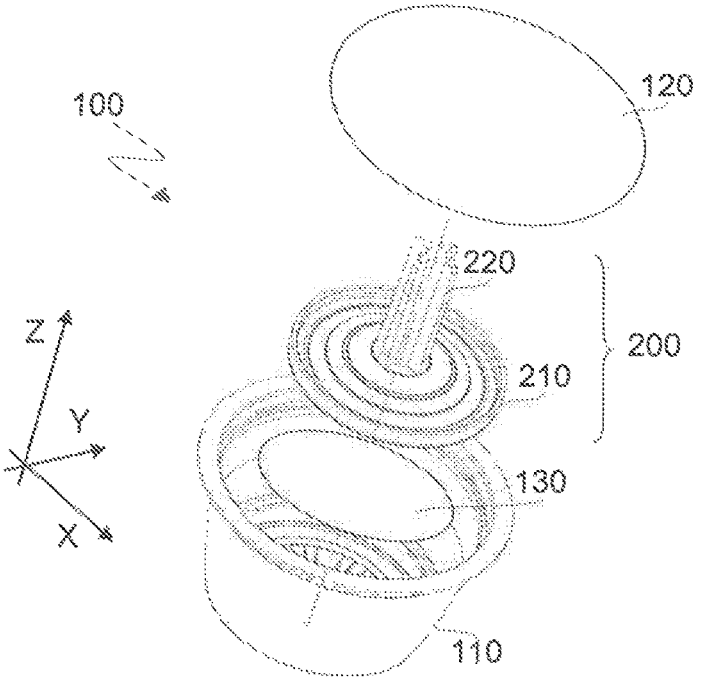
FIG. 3 is a perspective, exploded view of the capsule of FIG. 1.

Initially referring to FIGS. 1 to 5*a*, a disposable capsule according to the invention is generally indicated by reference numeral 100.

The capsule 100 comprises a cup-shaped hollow body 110 adapted to receive a measured dose of a syrup or, more generally, a liquid concentrate or a powder product such as coffee, milk, chocolate and the like.

The hollow body 110 comprises a bottom 111 and a peripheral wall 112 on whose top edge a flange 113 is formed. In a packaging configuration, the cup-shaped hollow body 110 is closed by a cover 120 (shown in transparency in FIG. 1) sealed on the flange 113. The cover may be e.g. a film made of a polylaminate material, which serves to seal the cavity so as to allow to preserve over time the granular or particulate product stored therein.

A through opening 114 is formed in the bottom 111 for the dispensing of the infused beverage obtainable from the product contained in the capsule 100. The through opening has for example a circular cross section.

In the illustrated embodiment, the through opening 114 has a funnel shape adapted to facilitate outflow of an infused beverage and is reinforced by a plurality of radial ribs 115.

The through opening 114 is sealed by a film 130 that is applied to the bottom 111 from the inside of the hollow body 110. The film is made, for example, of a polylaminate material and defines with the peripheral wall 112 and the cover 120 of the capsule body a closed chamber suitable to preserve the product in granular or particle form.

The capsule 100 further comprises an insert 200 housed in its body 110. The insert 200 extends axially from the bottom 111 of the hollow body 110 to the cover 120.

The insert 200 comprises a disc (i.e., a circular) portion 210 having a frustoconical shape with a peripheral rim 211 intended to rest on the bottom 111 of the body 110 of the capsule 100 and a mantle 212. The insert 200 is provided with perforation means associated with the disc portion 210. Such perforation means are one or more elements indicated by the reference numeral 213, projecting axially from the concavity of the disc portion 210 facing the inner film 130.

Figure 4A:
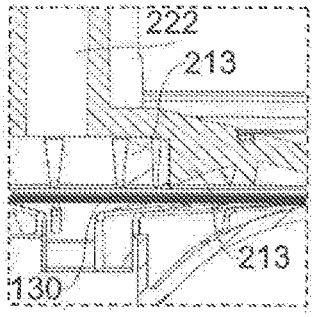
FIG. 4*a* shows a detail of an insert of the capsule of FIG. 4.
Figure 4:
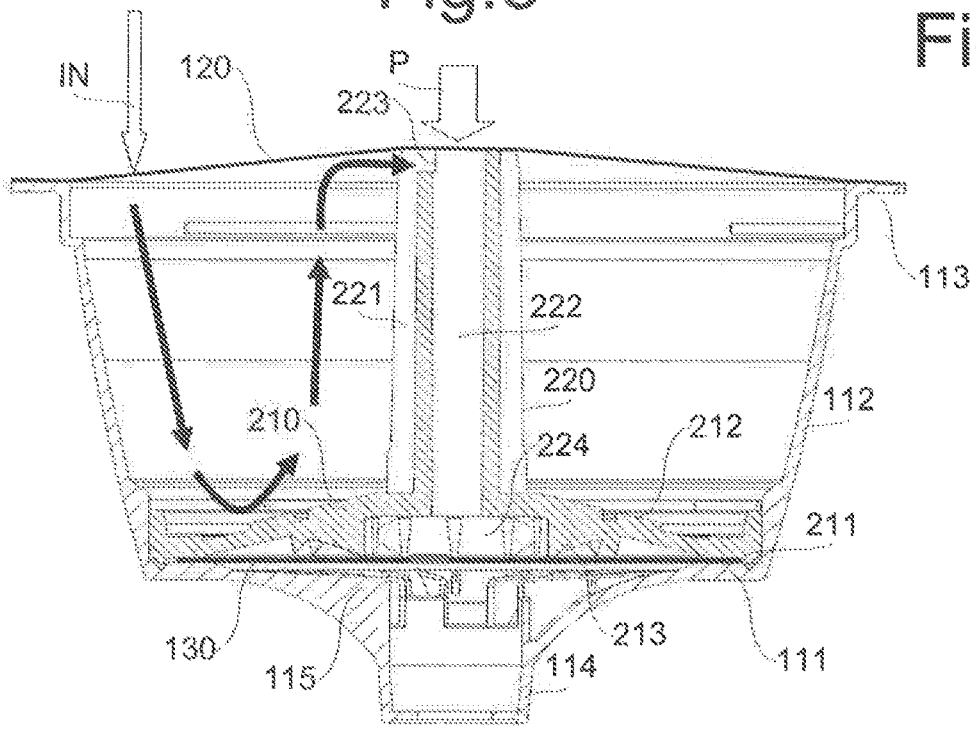
FIG. 4 is a longitudinal sectional view of the capsule of FIG. 1.

As shown in FIG. 4 and in the detail of FIG. 4*a*, the perforation elements 213 may have, for example, the shape of a flap.

Figure 5:
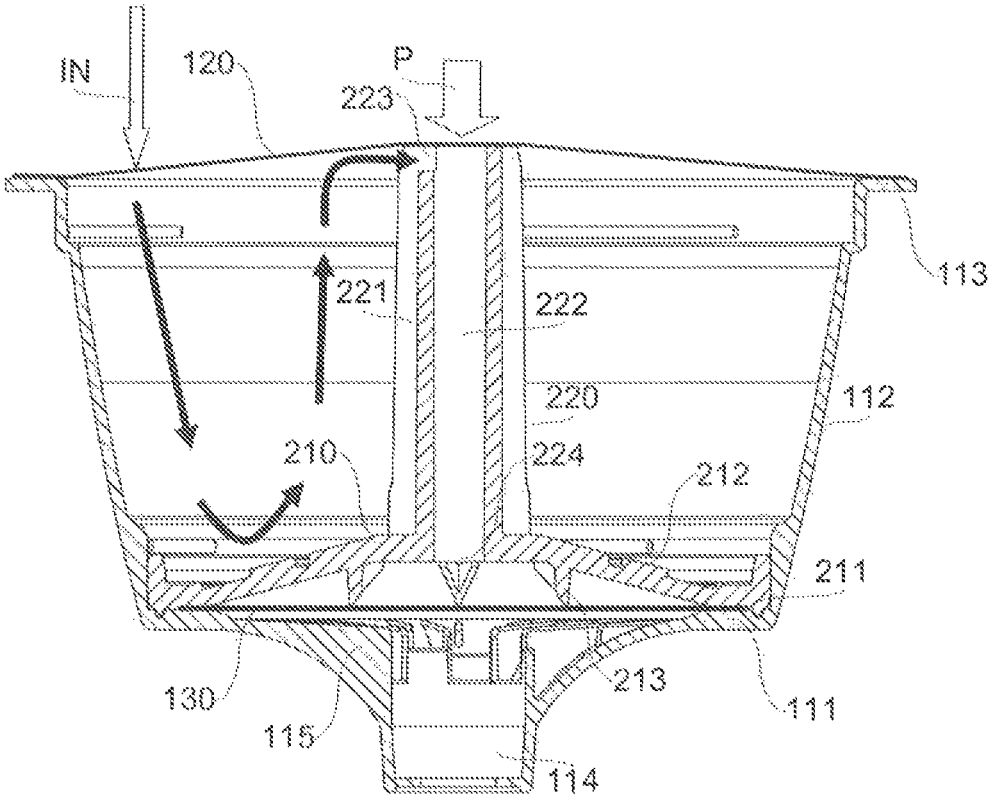
FIG. 5 is a longitudinal sectional view similar to the view of FIG. 4, wherein the capsule comprises an insert having perforation elements of a different type.
Figure 5A:
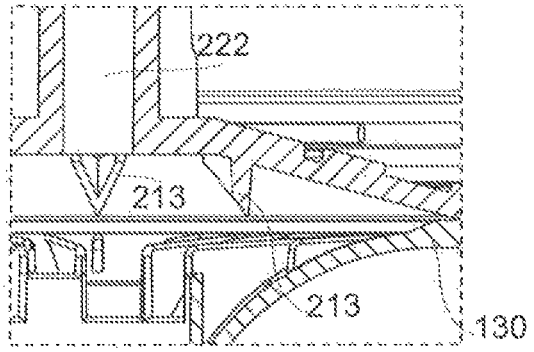
FIG. 5*a* shows a detail of the insert of the capsule of FIG. 5.
Figure 6:
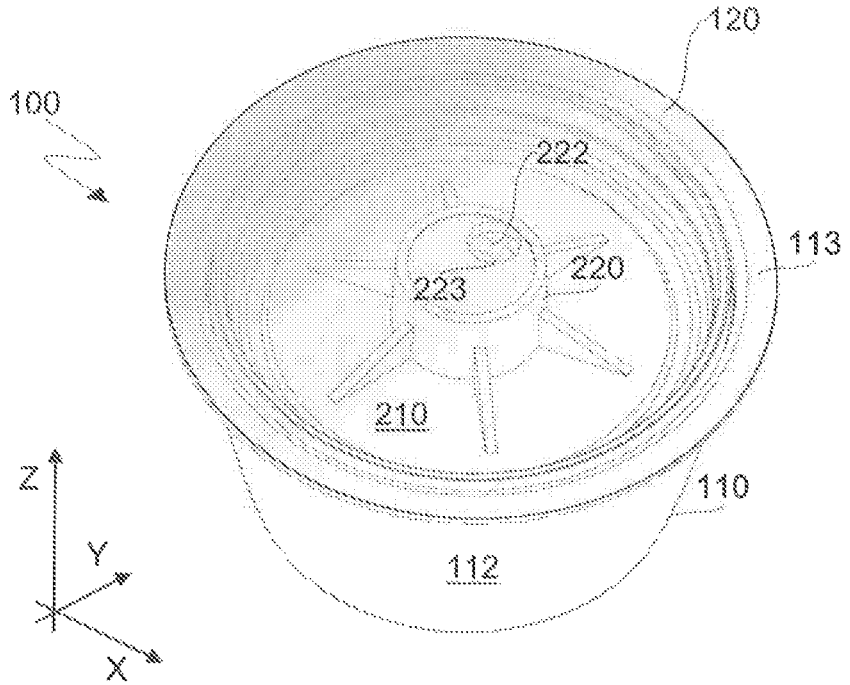
FIGS. 6 and 7 are perspective top and bottom views, respectively, of a capsule according to an alternative embodiment of the invention.
Figure 7:
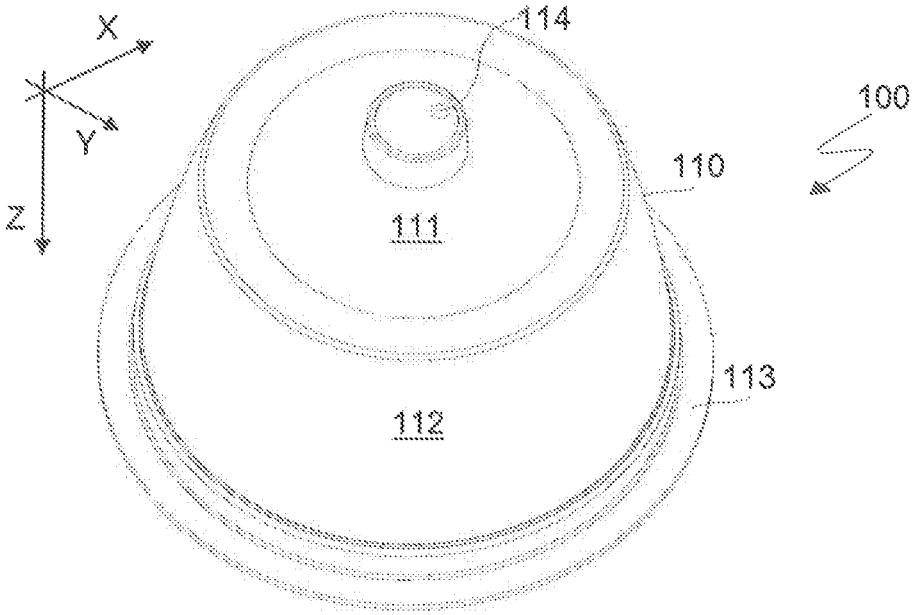
Figure 8:
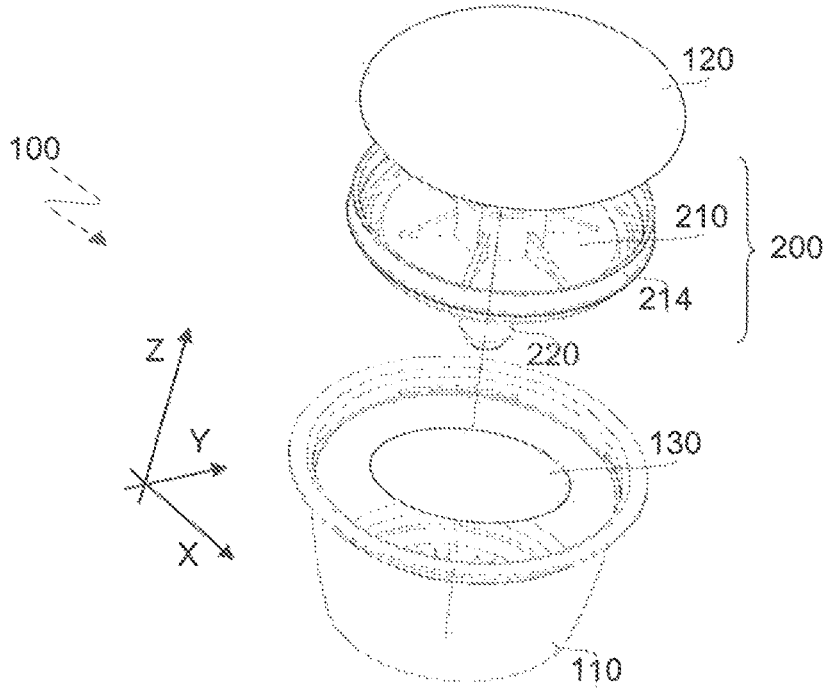
FIG. 8 is a perspective, exploded view of the capsule of FIG. 6.

As shown in FIG. 5 and in the detail of FIG. 5*a*, the perforation elements may alternatively have a dovetail shape that allows not only to cut the inner film 130, but also to move its cut portions towards the through opening 114 so as to facilitate dispensing of the infused beverage.

The insert 200 also comprises a stem 220 extending axially from the frustoconical portion 210. The free end of the stem 220 extends axially beyond the flanged rim 113 of the capsule body 110, so that in an assembled configuration of the capsule the cover 120 is deformed and assumes a convex or dome shape.

In the illustrated embodiment, the stem 220 also advantageously comprises reinforcing ribs 221 extending radially outwards.

According to the invention, the stem 220 also has an axial through cavity 222 defining a channel for the dispensing of a beverage. The through cavity comprises an inlet 223 formed close to a free end thereof, and hence close to the cover 120, and an outlet 224 formed at the opposite end, and thus facing the inner film 130 applied to the bottom 111 of the hollow body 110.

It is known that, when inserting a capsule 100 into a dispensing machine for infused beverages, the infusion chamber of the machine is tightly closed thereby locking the capsule 100. Locking typically occurs at the flanged edge of the capsule. The cover 120 is compressed in the direction indicated by arrow P and is perforated during the closing step or immediately afterwards by one or more injection needles that allow injection of an infusion liquid. In FIGS. 4 and 5, an arrow IN schematically indicates the position of an injector needle. Consequently, the stem 220 is moved axially and the frustoconical disc portion 210 is flattened onto the bottom 111, so that the perforation elements 213 cut the inner film 130 and form respective openings for the dispensing of an infused beverage via the through aperture 114.

The overall configuration of insert 200 is such that, when an infusion liquid is injected into the cavity of capsule 100, it is directed to its bottom 111, mixed with the product contained in the cavity and forms a beverage that flows back to the cover 120 until it reaches the inlet 223 and enters the channel 222 defined by the stem 220. The beverage then flows out of the capsule 100 through the outlet 224.

In other words, dispensing of an infused beverage from the capsule 100 occurs as it happens in a siphon, which eliminates leakage problems typically occurring at the end of a dispensing step due to residues of the infusion liquid remaining inside the capsule.

The arrows in FIGS. 4 and 5 schematically show the flow of the infusion liquid and of the infused beverage inside the capsule 100.

As shown in the longitudinal section of FIG. 4 and also in FIG. 5, the perforation elements 213 of the insert 200 are preferably arranged radially spaced from the outlet 224. Therefore, the flow of an infused beverage coming out from the channel 222 does not reach the through opening 114 directly, but is deviated radially by the inner film 130 until it reaches the openings made therein by the perforation elements 213. This feature provides the advantage of reducing swirling of the beverage and bubble formation, thus improving its organoleptic qualities.

Now referring now to FIGS. 6 to 10 an alternative embodiment of the capsule according to the invention is disclosed.

As it may be seen, in this case the insert 200 is substantially arranged upside down if compared to the insert of the embodiment described above, i.e. with the disc shaped portion 210 restrained close to the top of the capsule 100 and the stem 220 extending axially from the disc shaped portion 210 to the bottom 111 of the capsule 100.

The disc portion 210 is restrained close to the top of the capsule 100 by way of a breakable annular element indicated by reference numeral 214.

Similarly to the embodiment described above, the stem 220 comprises an axial through cavity 222 defining a channel for dispensing a beverage. The through cavity 222 comprises an inlet 223 close to its free end, and hence to the cover 120, and an outlet 224 formed at the opposite end and therefore facing the inner film 130 applied to the bottom 111 of the hollow body 110.

Figure 9:
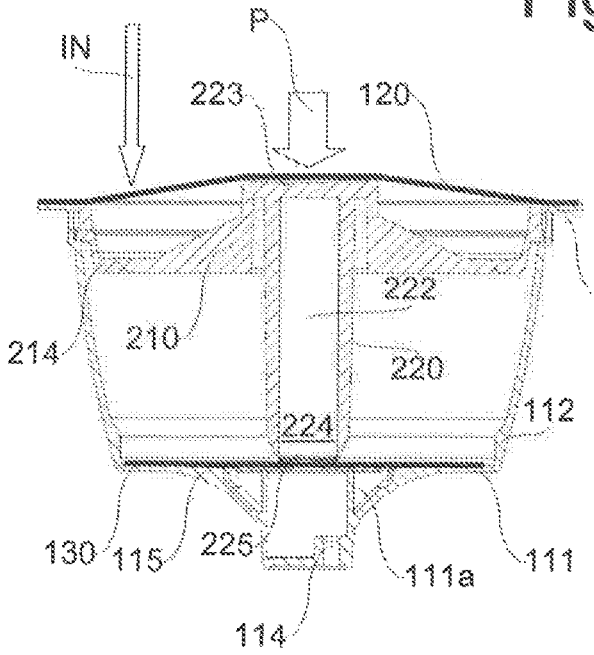
FIGS. 9 and 10 are longitudinally sectional views of the capsule of FIG. 6 respectively showing a packaging configuration and an operational configuration thereof.
Figure 10:
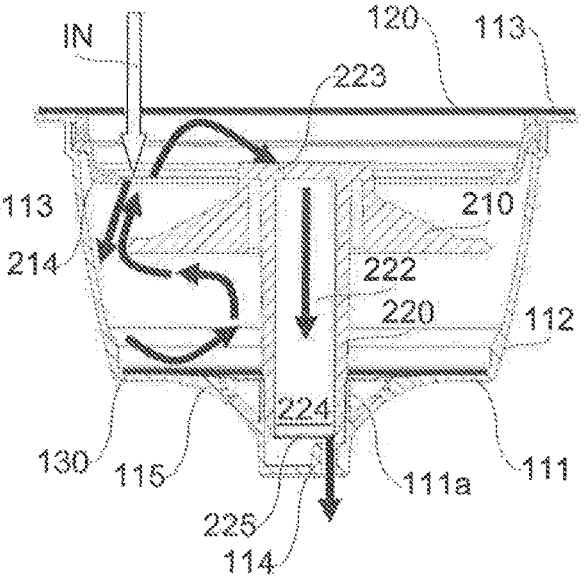

With particular reference to FIGS. 9 and 10, upon closure of the capsule 100 in an infusion chamber, the disc portion 210 is pressed down onto the bottom 111 as schematically shown by the arrow P and is detached from the annular element 214 that supports it in a packaged condition. The stem 220 of the insert 200 cuts the inner film 130 which seals the bottom 111 of the capsule 100 thus approaching the inlet opening 114. It will be appreciated that in this case the perforation means of the insert 200 are formed by the peripheral edge 225 surrounding the outlet 224 of the stem 220. In order to facilitate cutting of the inner film 130, the peripheral edge 225 may advantageously be sharpened, for example tapered and/or provided with a saw tooth profile.

It will be appreciated that in this condition the stem 220 engages the opening formed in the inner film as a cap, thereby preventing dispensing of the infused beverage, which is forced to flow up towards the cover 120 of the capsule 100 and enter the channel 222.

A centering element may advantageously be formed on the bottom 111 of the capsule 100 at the through aperture 114. The centering element is configured to receive the stem 220 during its axial movement, thus facilitating its movement relative to the through opening 114 and improving its plug behavior. The centering element, indicated by reference numeral 111*a*, may for example be a cylindrical collar extending axially from the bottom 111 to the cover 120.

The arrows in FIG. 10 schematically show the flow of the infusion liquid and of the infused beverage inside the capsule 100. It will be noted that the flow path is quite similar to that of the first embodiment of the invention described above.

In the illustrated embodiment, the through opening 114 for dispensing the infused beverage from the capsule 100 has a smaller cross section than the cross section of the channel 222 defined by the hollow stem 220. This configuration of the through opening 114, which is not essential for the invention, has the effect of accelerating the outflow of the beverage. This feature is very advantageous in the case of beverages based on syrups and liquid concentrates, since it promotes their mixing not only inside the capsule but also along the exit path from it.

The present invention has been described hereinabove with reference to preferred embodiments thereof. It will be appreciated that further embodiments relating to the same inventive idea may exist, as defined by the scope of protection of the claims set out below.

The invention claimed is:

1. A disposable capsule configured for being inserted in machines for preparing a beverage, said disposable capsule comprising:

i) a hollow, cup-shaped body configured to receive a measured dose of a syrup, a liquid, or a powder concentrate, said hollow cup-shaped body comprising a bottom into which a through opening is formed and a peripheral wall on whose peripheral edge a flange is formed;

ii) a cover fixed on said flange;

iii) a film applied on said bottom inside the hollow cup-shaped body so as to seal said through opening; and iv) an insert housed in said hollow cup-shaped body, said insert comprising a circular-shaped portion and a stem which stretches out axially from the top of said circular-shaped portion;

wherein the insert comprises perforation elements configured to axially move between a packaging position, wherein the stem presses against the cover deforming the cover outwards, and an opening position, wherein the stem is configured to advance axially towards the film and pierces the film by way of said perforation elements, and wherein the stem comprises an axial through cavity which defines a channel for the dispensing of the beverage, said axial through cavity comprising an inlet formed at an end of the stem located in contact with the cover of the disposable capsule and an outlet formed at the opposite end of the stem and facing the film, said inlet and said outlet being in fluid communication with each other by said axial through cavity extending from said inlet to said outlet; and wherein the circular-shaped portion of the insert has a frustoconical shape comprising a peripheral edge that rests on the bottom of the hollow cup-shaped body of the disposable capsule and a mantle, and one or more of said perforation elements that protrude axially from a concavity of the mantle and face the film that seals the bottom.

2. The capsule according to claim 1, wherein said perforation elements have the shape of a flap.

3. The capsule according to claim 1, wherein said perforation elements have the shape of a dovetail.

4. The capsule according to claim 1, wherein the perforation elements of the insert are spaced from the outlet radially outwards.

5. The capsule according to claim 1, wherein said inlet and said outlet are positioned at opposite ends of said axial through cavity.

6. A disposable capsule configured for being inserted in machines for preparing a beverage, said disposable capsule comprising:

i) a hollow, cup-shaped body configured to receive a measured dose of a syrup, a liquid, or a powder concentrate, said hollow cup-shaped body comprising a bottom into which a through opening is formed and a peripheral wall on whose peripheral edge a flange is formed;

ii) a cover fixed on said flange;

iii) a film applied on said bottom inside the hollow cup-shaped body so as to seal said through opening; and iv) an insert housed in said hollow cup-shaped body, said insert comprising a circular-shaped portion and a stem which stretches out axially from the top of said circular-shaped portion;

wherein the insert comprises perforation elements configured to axially move between a packaging position, wherein the stem presses against the cover deforming the cover outwards, and an opening position, wherein the stem is configured to advance axially towards the film and pierces the film by way of said perforation elements, and wherein the stem comprises an axial through cavity which defines a channel for the dispensing of the beverage, said axial through cavity comprising an inlet formed at an end of the stem located in contact with the cover of the disposable capsule and an outlet formed at the opposite end of the stem and facing the film, said inlet and said outlet being in fluid communication with each other by said axial through cavity extending from said inlet to said outlet; and wherein the circular-shaped portion of the insert is restrained at a top region of the disposable capsule and the stem extends axially from the circular-shaped portion towards the bottom of the disposable capsule.

7. The capsule according to claim 6, wherein the circular-shaped portion is restrained at the top region of the disposable capsule by way of an annular element having a predefined breakage threshold.

8. The capsule according to claim 6, wherein a peripheral edge of the outlet of the stem is tapered or provided with a saw tooth profile.

9. The capsule according to claim 6, further comprising a centering member formed on the bottom in correspondence of the through opening, said centering member being configured so as to receive the stem during an axial movement of the stem towards the film.

10. The capsule according to claim 6, wherein the through opening of the disposable capsule has a cross section smaller than the cross section of the channel defined by the axial through cavity of the stem.

* * * * *